US005575068A

United States Patent [19]

Pedersen

[11] Patent Number: 5,575,068

[45] Date of Patent: Nov. 19, 1996

[54] SAFETY RAZOR

[75] Inventor: Jette B. Pedersen, Vejen, Denmark

[73] Assignee: Warner-Lambert Company, Morris Plains, N.J.

[21] Appl. No.: 313,140

[22] PCT Filed: Apr. 23, 1993

[86] PCT No.: PCT/DK93/00137

§ 371 Date: Jan. 3, 1995

§ 102(e) Date: Jan. 3, 1995

[87] PCT Pub. No.: WO93/22112

PCT Pub. Date: Nov. 11, 1993

[30] Foreign Application Priority Data

Apr. 27, 1992 [DK] Denmark ..... 0538/92

[51] Int. Cl.[6] ..... B26B 21/54

[52] U.S. Cl. ..... 30/47; 30/50

[58] Field of Search ..... 30/32, 47, 50

[56] References Cited

U.S. PATENT DOCUMENTS

| | | | |
|---|---|---|---|
| 3,777,396 | 12/1973 | Simonetti | 30/32 |
| 3,783,510 | 1/1974 | Dawidowicz et al. | 30/32 |
| 3,786,563 | 1/1974 | Dorion, Jr. et al. | 30/50 |
| 3,832,774 | 9/1974 | Perry | 30/32 |
| 3,892,036 | 7/1975 | Perry | 30/50 X |
| 4,275,498 | 6/1981 | Ciaffone | 30/47 |
| 4,407,067 | 10/1983 | Trotta | 30/50 |
| 4,980,974 | 1/1991 | Radcliffe | 30/50 |
| 5,133,131 | 7/1992 | Hoffman | 30/50 |

*Primary Examiner*—Hwei-Siu Payer
*Attorney, Agent, or Firm*—Charles W. Almer

[57] ABSTRACT

A shaving system comprises a cartridge which houses a leading blade member and a following blade member. Both of the blade members have a front cutting edge and a rear cutting edge. The cartridge can be reversed to allow use of the rear cutting edges.

4 Claims, 8 Drawing Sheets

SAFETY RAZOR

DESCRIPTION

The invention concerns a safety razor of the sort stated in the introduction to claim 1. Such safety razors are known from the descriptions to DK precept No. 144460 and U.S. Pat. No. 3,786,563.

It is a disadvantage of the conventional safety razors that the razor blades have been designed with only one cutting edge on one side, meaning that the blade cassettes have to be exchanged frequently. Furthermore, all conventional safety razors have a complicated construction.

This invention serves the purpose of procuring a safety razor of the sort mentioned in the introduction, where the razor blades are provided with a cutting edge on both sides, and a blade cassette, which can be turned inside the cassette holder, thus a blade cassette will last twice as long as that of any conventional safety razor.

According to the invention this purpose is achieved through the fact that the safety razor mentioned in the introduction is peculiar as to the characterizing part stated in claim 1.

Through this a more simple construction of the safety razor will also be reached, and there will be a decrease in tool costs.

Claim 2 concerns special locking devices through which the cap section of a blade cassette can be locked to the base section.

Claim 3 concerns a special construction of both the blade cassette with exterior mating surfaces and the cassette holder with interior control surfaces, through which a blade cassette can be locked unambiguously in the cassette holder, and claim 4 concerns special devices through which a blade cassette can be locked in position in proportion to the cassette holder.

A detailed explanation of the invention shall follow referring to the drawing on which FIG. 1 shows a sectional view of a safety razor as to the invention mounted with a blade cassette in the cassette holder.

Figure 1:
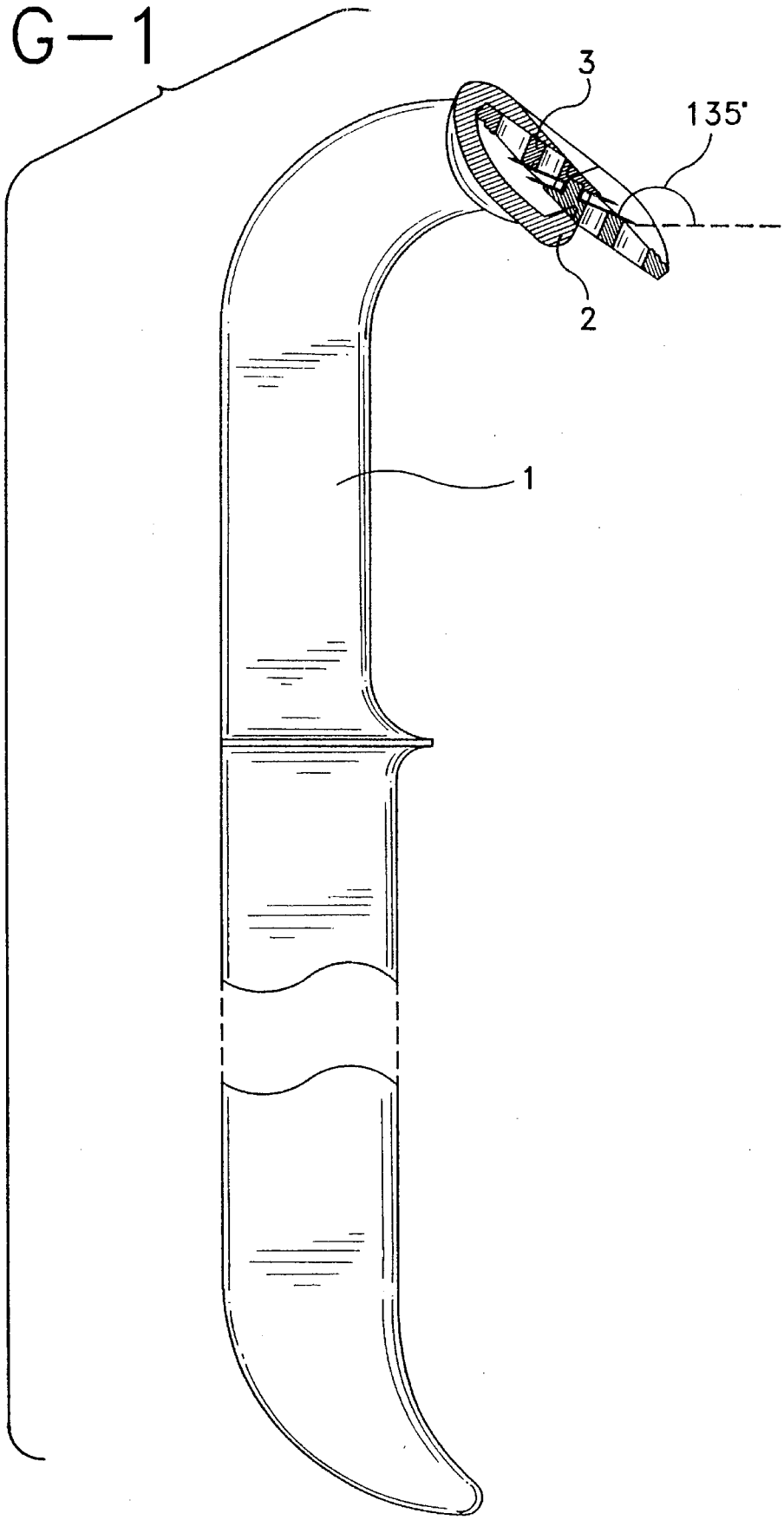
Figure 2:
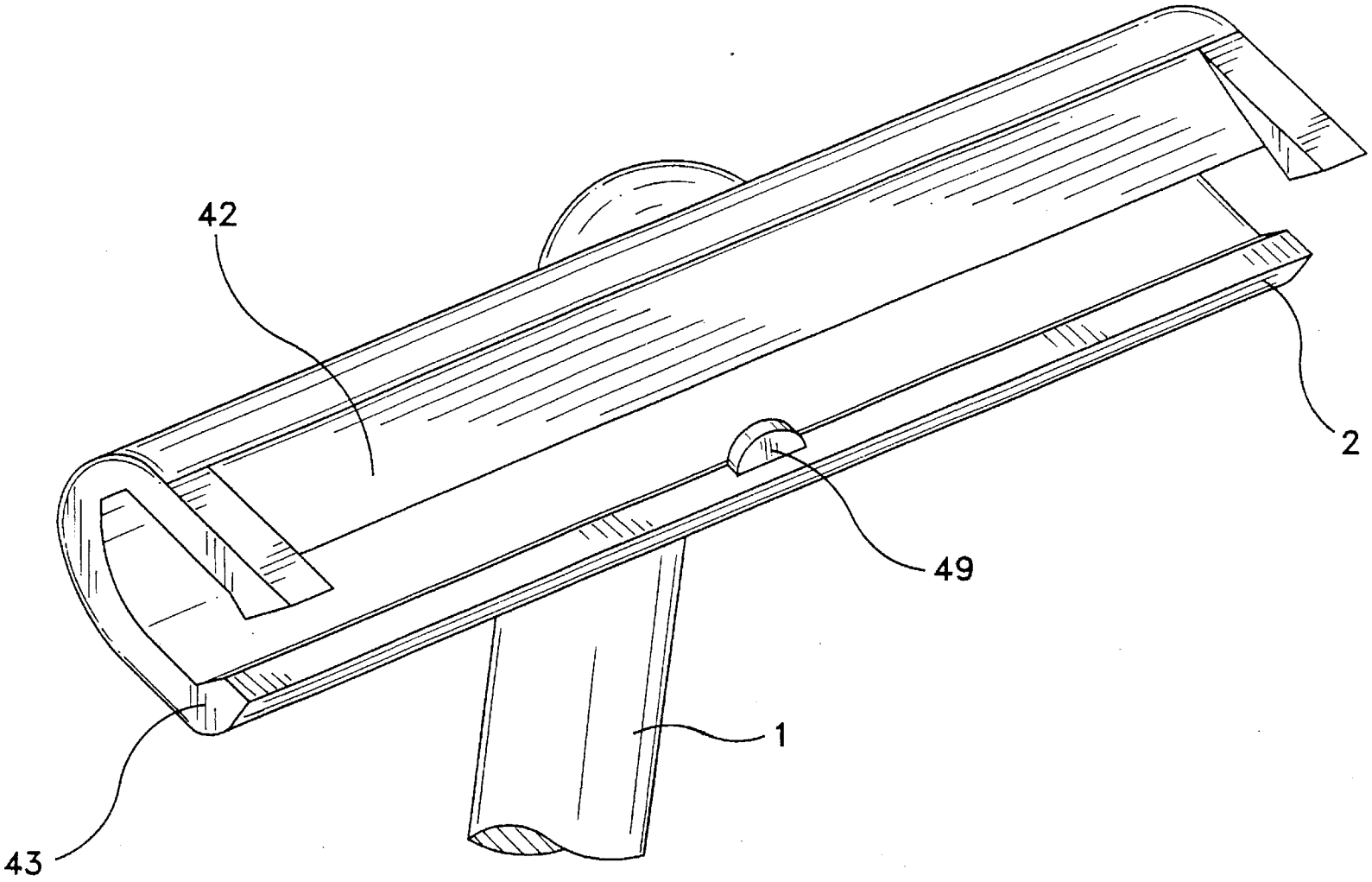
FIG. 2 shows on a larger scale and in perspective a cassette holder for the safety razor shown in FIG. 1.
Figure 3:
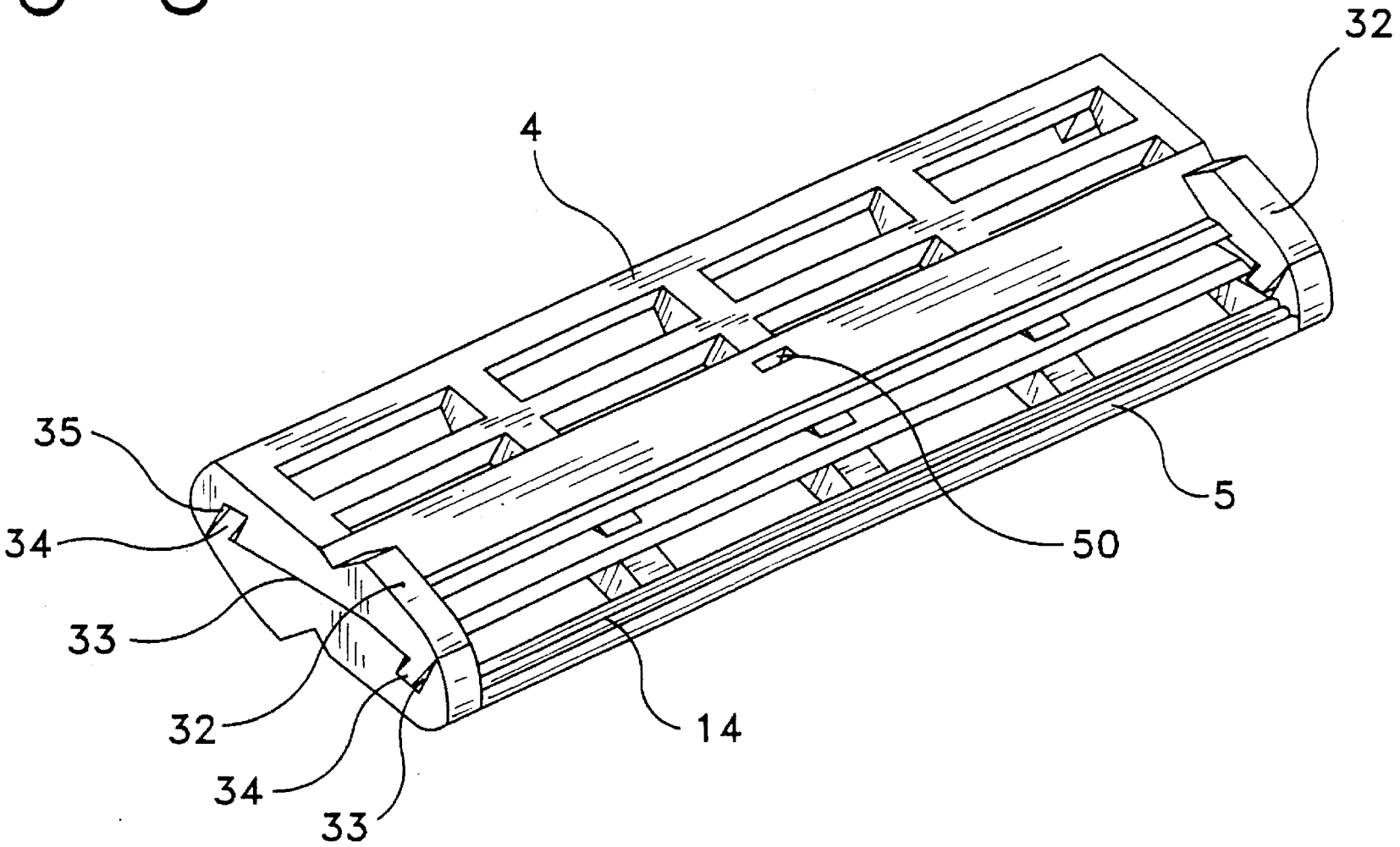
FIG. 3 shows on a larger scale and in perspective a blade cassette for a safety razor as to the invention.

The safety razor has, as it is seen from FIG. 1 a handle 1, which at the top ends in a cassette holder 2 in which a demountable blade cassette has been mounted.

Figure 4:
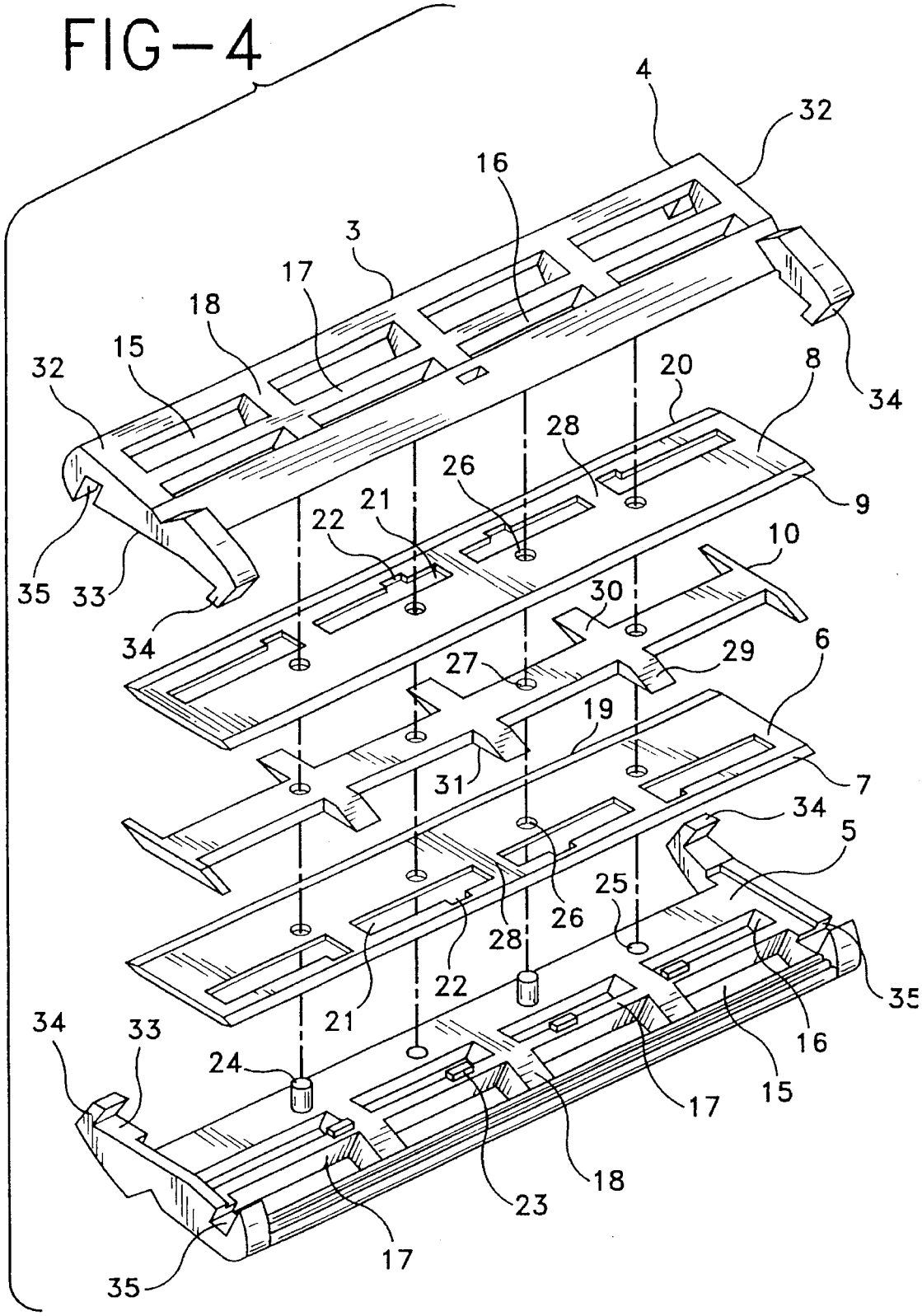
FIG. 4 shows a separated blade cassette.
Figure 5:
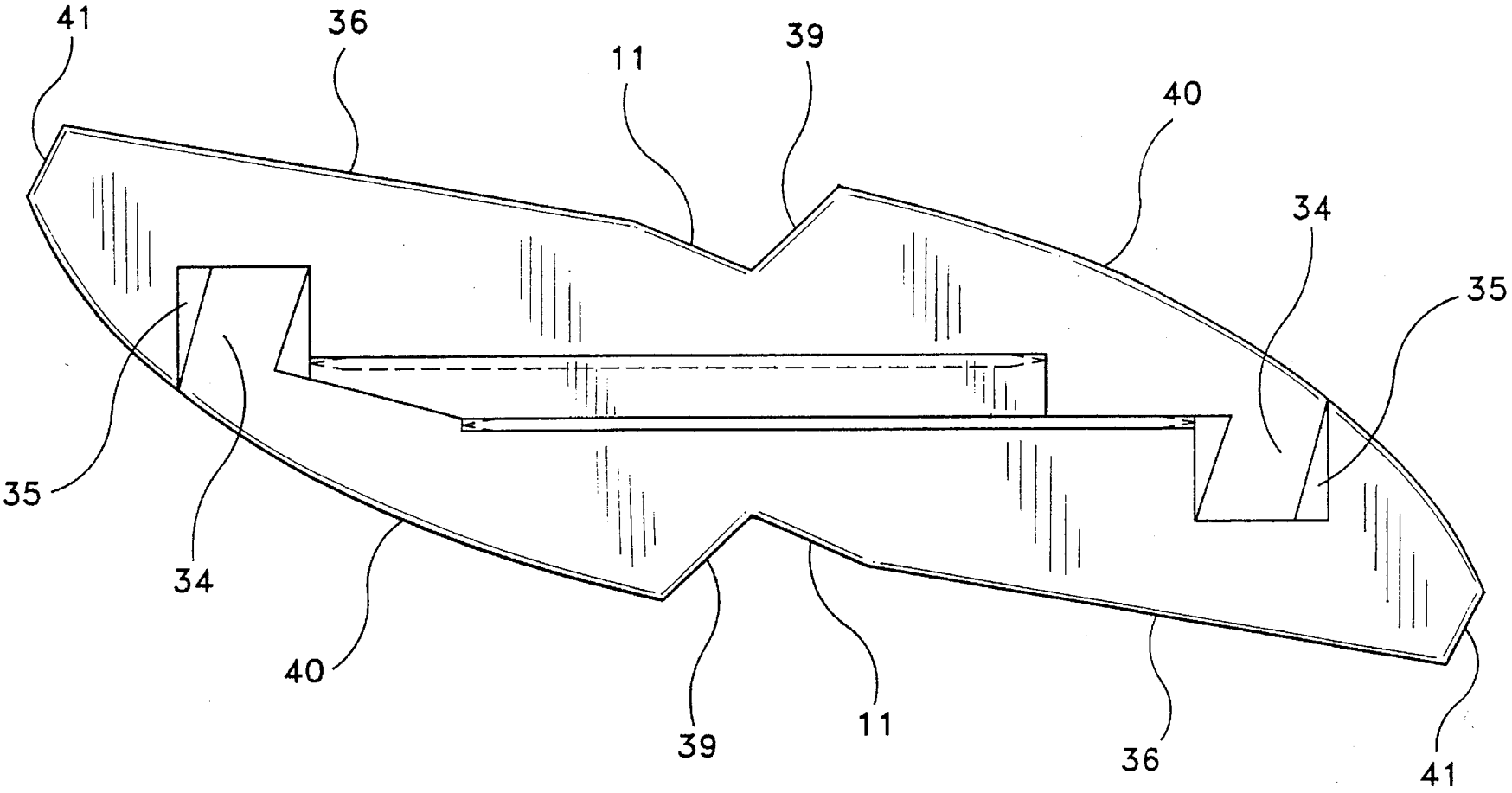
FIG. 5 shows a rear view of the blade cassette.
Figure 6:
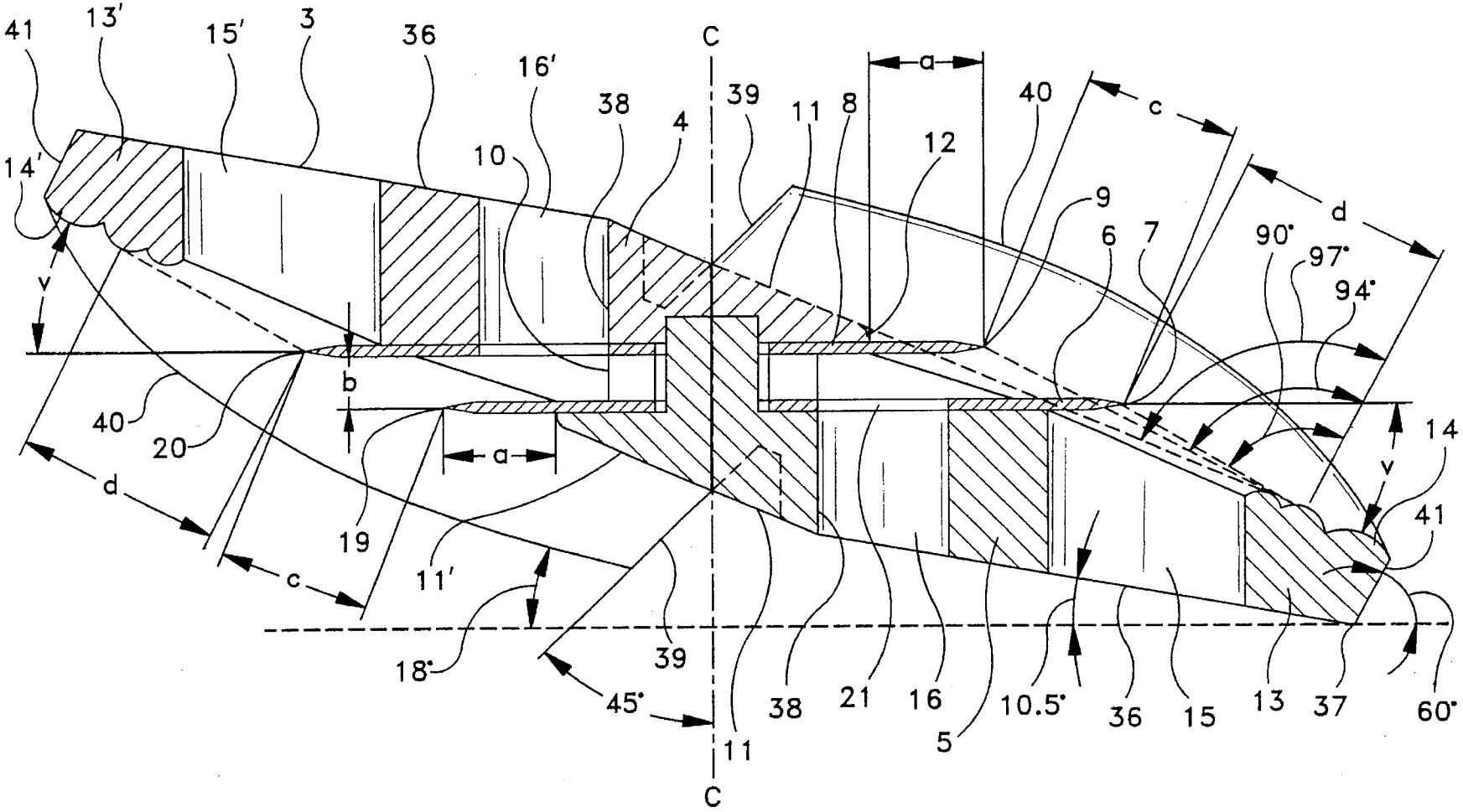
FIG. 6 shows a cut through a blade cassette.

As shown on FIG. 4 and 6 a blade cassette 3 consists of a cap section 4 and a base section 5. Between the cap section and the base section a front-lying, lengthy razor blade 6 with a cutting edge 7 in front; lying behind it and parallel to it a rear lengthy razor blade 8, which on its frontside has a cutting edge 9, have been mounted. The blades are held in a certain mutual distance b, which e.g. could be 0.5 mm, through a distance piece 10. The body part 4 has been designed with a contact face 11, being in contact with the skin during shaving. The front edge 12 of the contact face 11 has been somewhat drawn back a e.g. 0.63 mm in comparison to the edge 9 of the blade 8. The contact face 11 has been positioned in a lower level than a plane through the cutting edges 7 and 9, and could e.g. form an angle of 23° with the plane of the blade 8. The base section 5 protrudes in front of the cutting edge 7 of the blade 6 and has on its front a longitudinal edge or bearer 13, which on top has a wavy contact face 14, which is in contact with the skin during shaving. The contact face 14 has also been placed in a level, which is lower than that of a plane through the cutting edges 7 and 9. Behind the bearer 13 there is a base section 5 with a first row of cut-outs 15, and in some distance from there a second row of cut-outs 16. The cut-outs 15 and 16 are separated by a longitudinal edge 17 and the cut-outs 15,16 are separated in a crosswise direction by the edges 18.

The blades 6 and 8 have been placed in a certain mutual distance c between the cutting edges 7 and 9, e.g. being 1.0 mm, as well as between and in a certain distance d from the edge 7 and the first wave of the contact face 14, e.g. being 1.20 mm. Furthermore the blades 6 and 8 have been mounted considering a certain angle v, e.g. being 31° with a plane through the edge 7 and the top of the first wave of the contact face 14. The cassette holder 2 can be placed so in proportion to the handle 1 and the blade cassette 3 can be placed so in proportion to the cassette holder 2 that the blades 6 and 8 and the handle form an angle of e.g. 65°.

Behind the edge 7 there is a blade 8 provided with a row of cut-outs 21, which—when mounted in the blade cassette 3—levels with the second row of cut-outs of the base section 5 and thus allows scraps from shaving from the cutting edge 9 to pass. Scraps from shaving from the front edge 7 are led through the first row of cut-outs 15 of the base section 5.

Connected to each cut-out 21 is a blade 6 designed with an extra, short cut-out 22 into each of which a dowel 23 with a cross-sectional shape identical to the cut-out 22 can be adapted. These dowels are placed on the longitudinal edges 17.

Behind the cut-outs 16 of the base section 5 the construction includes e.g. two dowels 24 and two holes 25. The cap section 4 has on level with the dowels 24 holes 25 and on level with the holes 25 dowels 24. The blades 6 and 8, and the distance piece 10 has been constructed with holes 26 and 27, respectively, through which the dowels 24 have been led during assembly of the blade casette. The cap section 4, the blade 8, the distance piece 10, the blade 6 and the base section 5 have been directed into a precise mutual position by the dowels 24 during the assembly of the cassette.

The blade 6 is on the long side opposite to the edge 7 provided with another edge 19, and the blade 8 is on the side opposite to the edge 9 provided with another edge 20.

The distance piece 10 has, on level with the edges 28 between the cut-outs 21 of the blades 6 and 8, fingers 29 each having an upper contact face 30 to the blade 8 and a lower contact face 31 to the blade 6.

The contact faces 11' and 14' belonging to the cutting edges 19 and 20 have been designed as and placed with the same angles as exist between the contact faces 11 and 14 and the blades 6 and 8. The cut-outs 15' and 16' are constructed as the cut-outs 15 and 16, and they have been placed in the same mutual position to the edges 19 and 20 as exist between the cut-outs 15 and 16 and the edges 7 and 9. Furthermore the distances a, c and d are identical to both sets of edges.

The two blades 6 and 8 may be of uniform design, and the blade 8 is then mounted in the blade cassette in a turned position of 180° in proportion to the blade 6.

The cap section 4 may be designed as the base section 5, but it is then mounted in the blade cassette 3 in a turned position of 180° in proportion to the base section 5.

The base section 5 and the cap section 4 have at both ends an end piece 32. Each end piece has, on the side which is turned against each other inside the assembled blade cassette, a mating surface 33. Each end piece also has at one end a dowel 34 and at the other end a cut-out or a recess 35.

During assembly of a blade cassette the two dowels 34 of the cap section 4 may mesh in a self-locking grip with the two cut-outs 35 of the base section 5, and the two dowels 34 of the base section 5 a grip with the two cut-outs 35 of the cap section, in which position the two mating surfaces 33 of each end piece 32 will meet.

Figure 7:
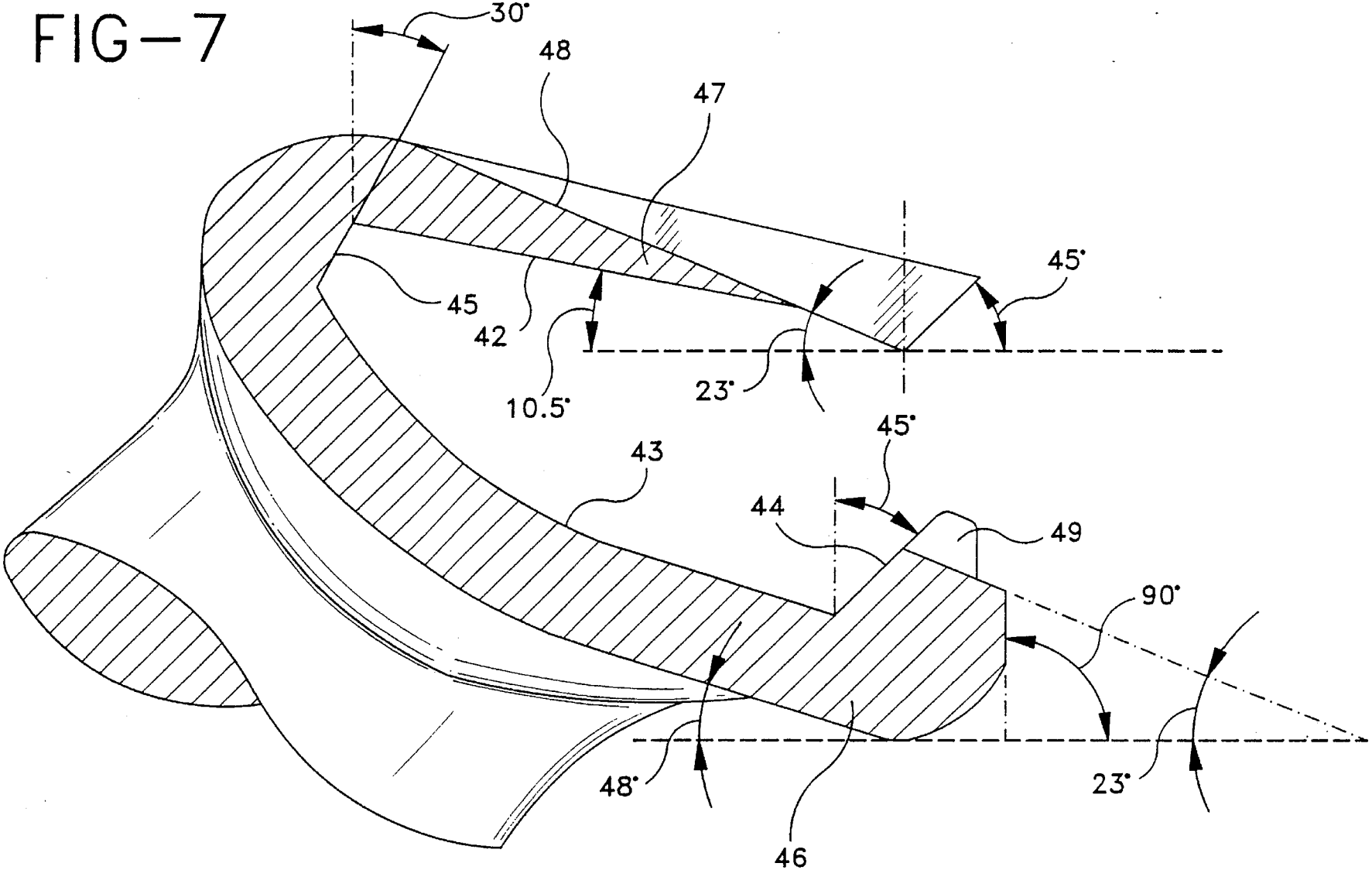
FIG. 7 shows a cut through a cassette holder for a safety razor as to the invention.
Figure 8:
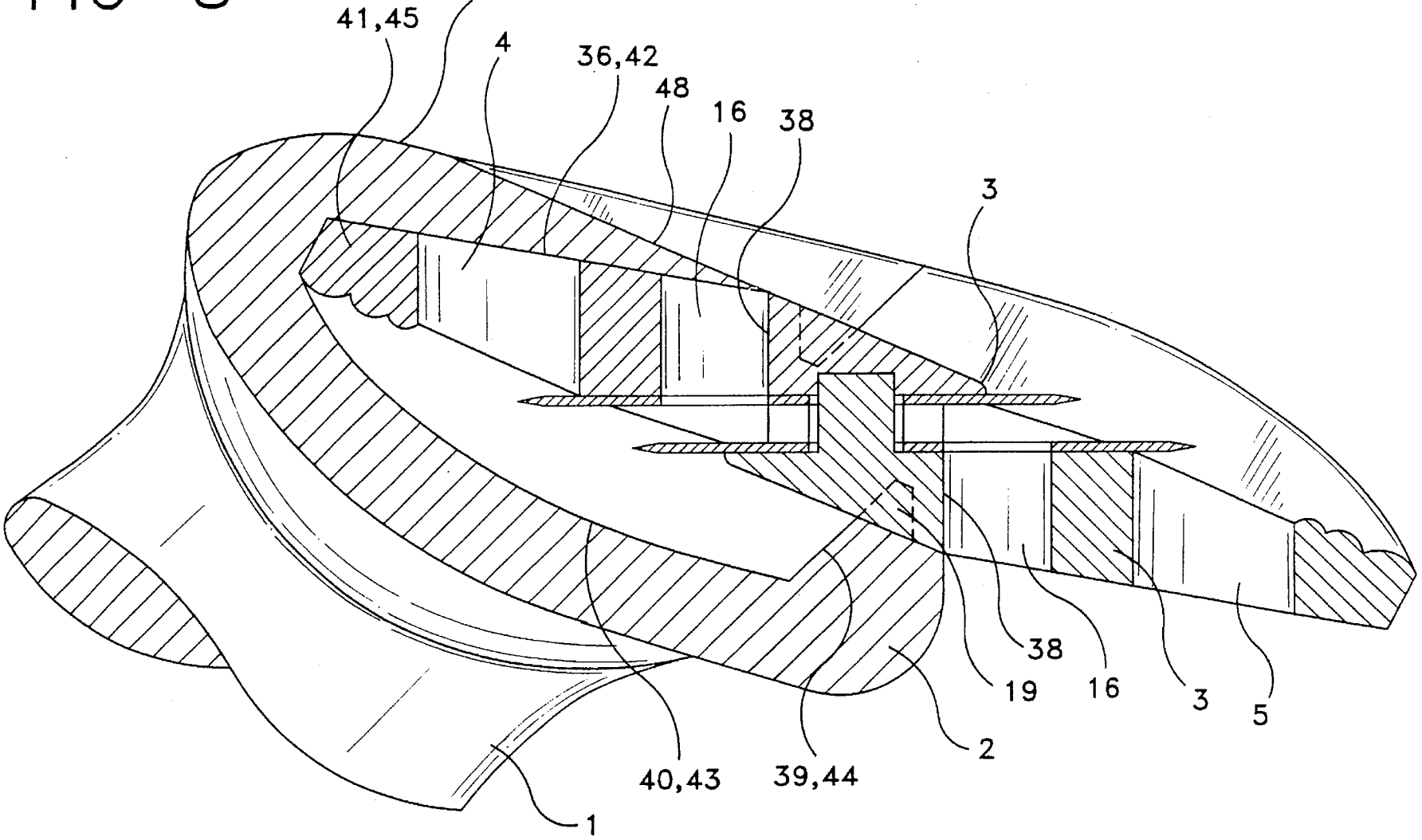
FIG. 8 shows a cut through a cassette holder, in which a blade cassette has been mounted.

As it is seen from FIG. 6, 7 and 8 in particular the blade cassette 3 has been constructed with mating surfaces, and the cassette holder has been provided with interior control surfaces constructed to maintain the cassette holder 3 in a specific, definite first position as well as in an alternate position where it is turned 180° around a central axis in the cassette, meaning that the blades 6 and 8 form the same angle with the handle as that of the position mentioned first.

With reference to the base section 5 the mentioned mating surfaces may consist of the first mating surface 36 stretching from the lower edge 37 of the bearer 13 to for instance the rear edge 38 of the cut-out 16 from where the surface 36 continues to the contact face 11 and from there to the centre line C—C. After that the mating surface continues into surface 39 and another surface 40 both of which are shaped into end pieces 32. Similar mating surfaces are found on the top side of the cap section 4. The frontside of the bearer 13 has been provided with an additional mating surface 41.

The cassette holder has both an interior, upper control surface 42, which matches the mating surface 36, and a lower control surface 43, which matches the mating surfaces 40 of the two end pieces 32. In front the control surface 43 continues into a front control surface 44, which matches the mating surface 39, and at the back it continues into a rear control surface 45, which matches the mating surface 41.

The bottom piece 46 and the top section 47 of the cassette holder has been placed so that they up front end by the rear edge 38 of the cut-outs 16 in the base section 5 and the cap section 4, respectively, in a blade cassette 3 mounted in the cassette holder 2. The top section 47 ends in a front tip, and the top side 48 of the top section is even with the same gradient as the contact face 11. As shown the bottom piece 46 may be provided with a dowel 49, which meshes with a hole 50 of the base section 5 or of the cap section 4 and locks the blade cassette 3 into its position.

The safety razor which has been shown and described is only one example of the invention. Other designs and constructions may be developed within the limits of the invention. The mating surfaces as well as the control surfaces may be elaborated differently.

I claim:

1. A safety razor comprising:

a handle (1);

a cassette holder (2) having a bottom piece (46) and a top piece (47), said cassette holder (2) attached to said handle (1);

a blade cassette (3) removably mounted in said cassette holder (2);

said blade cassette (3) comprising a cap section (4), a base section (5), a front blade (6) having a front cutting edge (7), a rear blade (8) having a rear cutting edge (9), and said front and rear cutting edges (7, 9) providing a cassette geometry;

said cap section (4) having a contact face (11) positioned in a level lower than the plane passing through the cutting edges (7, 9), and a front edge (12) positioned rearward of said rear cutting edge (9);

said base section (5) protruding forwardly of said front cutting edge (7), and having a longitudinal bearer (13) on the front side thereof;

said bearer (13) having a wavy contact face (14) provided thereon in a level lower than said plane;

said base section (5) having a first row of cut-outs (15) provided rearward of said bearer (13), and a second row of cut-outs (16) provided below said front blade (6);

said blades (6, 8) being mounted at a mutual blade distance (b) by a distance piece (10), said two cutting edges (7, 9) spaced apart at a cutting edge distance (c), a contact-face/cutting-edge distance (d) between said wavy contact face (14) and said front cutting edge (7), and a cutting edge/contact-face angle (v) formed between said front cutting edge (7) and a first wave of said wavy contact face (14);

said front blade (6) having an additional cutting edge (19) on the side opposite to said front cutting edge (7), and said rear blade (8) having an additional cutting edge (20) on the side opposite to said rear cutting edge (9);

said additional cutting edges (19, 20) having an additional cassette geometry defined by a contact face, a wavy contact face, blade/cutting-edge distances and a cutting edge/contact-face angle, and said additional cassette geometry being identical to the cassette geometry of said front and rear cutting edges (7, 9);

said front and rear blades (6, 8) having the same construction and each having two holes (26, 27), said rear blade (8) being mounted in a turned position of 180 with respect to said front blade (6);

said base section (5) having, on the end opposite to said bearer (13), two dowels (24) fitting into each hole (25) in said cap section (4), said dowels (24) passing through said two holes (26, 27) of said front and rear blades (6, 8) and through said distance piece (10);

said cap section (4) and said base section (5) having the same construction, and said cap section (4) being mounted in a turned position of 180 with respect to said base section (5); and said blade cassette (3) being provided with exterior mating surfaces and said cassette holder (2) being provided with interior control surfaces for allowing said blade cassette (3) to be held in a first locked position in said cassette holder (2), and in a second turned position of 180 around a center axis (0) with respect to said first position.

2. A safety razor according to claim 1, wherein said base section (5) and said cap section (4) each have an end piece (32);

said end pieces (32) each have a mating surface (33) which contains a dowel (34) at one end and a cut-out or recess (35) at the other end; and said dowels (34) and cut-outs or recesses (35) are constructed and located so that the dowels (34) mesh in a self-locking grip with the cut-outs or recesses (35) so that the mating surface (33) of the cap section (4) is in contact with the mating surface (33) of the base section.

3. A safety razor according to claim 1, wherein the bottom of the base section (5) has at least one mating surface (36), said mating surface (36) extending from the lower edge of the bearer (13) to the rear edge (38) of the second row of cut-outs (16), to the contact face (11) and to the cutting edge (19);

wherein the mating surface (36) and a portion of the contact face (11) extend through the blade cassette (3) to a center line (c—c) and to the underside of end pieces (32) of the cap section (4), the end pieces (32) of the cap section (4) having a first even mating surface (39) and a second mating surface (40);

said cassette holder (2) comprising an interior control surface (42) and a lower control surface (43) which correspond with the mating surfaces (36 and 40) respectively, and a front-lying control surface (44) and a rear control surface (45) which correspond with the first mating surface (39) and a mating surface on the front side of the bearer (13) respectively;

wherein said blade cassette (3) can be inserted into the cassette holder (2) and means are provided to lock the blade cassette (3) into position in the cassette holder (2); and wherein the bottom piece (46) and the top piece (47) of the cassette holder (2) end at the rear edge (38) of the cut-outs (16) in the base section (5) and the cap section (4) respectively of the blade cassette (3).

4. A safety razor according to claim 1, wherein the bottom piece (46) contains a dowel (49) and wherein said dowel (49) is capable of meshing with a hole (50) which is located in either the base section (5) or the cap section (4).

* * * * *